US012089763B2

(12) United States Patent
Ercolano et al.

(10) Patent No.: US 12,089,763 B2
(45) **Date of Patent: *Sep. 17, 2024**

(54) ORNAMENT-HANGING HOOK AND SYSTEM

(71) Applicants: Donna Ercolano, San Diego, CA (US); Debra Bevelaqua, San Diego, CA (US)

(72) Inventors: Donna Ercolano, San Diego, CA (US); Debra Bevelaqua, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/352,514

(22) Filed: Jul. 14, 2023

(65) Prior Publication Data

US 2023/0355022 A1 Nov. 9, 2023

Related U.S. Application Data

(62) Division of application No. 17/188,815, filed on Mar. 1, 2021, now Pat. No. 11,986,116.

(51) Int. Cl.
*A47G 33/10* (2006.01)
*A44B 13/00* (2006.01)

(52) U.S. Cl.
CPC ..... *A47G 33/10* (2013.01); *A44B 13/0005* (2013.01)

(58) Field of Classification Search
CPC ..... A47G 33/10
See application file for complete search history.

(56) References Cited

U.S. PATENT DOCUMENTS 5,553,905 A * 9/1996 Bentivegna ..... B25J 1/04 294/24
D398,516 S * 9/1998 Brown ..... D8/370
5,964,489 A * 10/1999 Mahoney ..... A47G 33/10 248/339
D432,264 S * 10/2000 Nicol ..... D28/39
6,155,526 A * 12/2000 Brown ..... A47G 33/10 248/303
6,227,584 B1 * 5/2001 Reuther ..... F21V 19/04 294/104
6,352,291 B1 * 3/2002 Tortajada ..... F21S 4/10 294/24
6,652,013 B1 * 11/2003 Peterson ..... B25G 1/04 294/210
D492,890 S * 7/2004 Adams ..... D8/367

(Continued)

*Primary Examiner* — Mark Ruthkosky
*Assistant Examiner* — Julia L Rummel
(74) *Attorney, Agent, or Firm* — CP LAW GROUP PC; Cy Bates

(57) ABSTRACT

An improved ornament-hanging hook and system includes an ornament-hanging apparatus and one or more ornament-hanging hooks, wherein each of the one or more ornament-hanging hooks includes an ornament-engaging loop, a first engagement-element for engaging a tree branch or other hanging structure, and a second engagement element disposed between the ornament-engaging loop and the first engagement-element for contact with the ornament-hanging apparatus during hanging. The second engagement-element has a second bend having a plurality of flections, wherein a portion of the second bend forms a fulcrum. Upon engagement with the ornament-hanging apparatus at the fulcrum, an ornament attached at the ornament-engaging loop is balanced gravitationally such that the first-engagement element is positioned upright and in an unobstructed manner.

11 Claims, 5 Drawing Sheets

(56) References Cited

U.S. PATENT DOCUMENTS

| | | | | |
|---|---|---|---|---|
| D530,188 | S * | 10/2006 | Kalat | D8/370 |
| 7,350,756 | B2 * | 4/2008 | Woltmann | A01K 15/025 248/302 |
| 7,429,067 | B1 * | 9/2008 | Rosa | F21S 4/10 248/303 |
| D712,783 | S * | 9/2014 | Cortes | D11/130 |

* cited by examiner

ORNAMENT-HANGING HOOK AND SYSTEM

CROSS-REFERENCE TO RELATED APPLICATIONS

This application claims benefit of priority with U.S. Provisional Application Ser. No. 62/993,550, filed Mar. 23, 2020; the entire contents of which are hereby incorporated by reference.

BACKGROUND

Field of the Invention

The invention relates to decorative ornament hanging systems; and more particularly, to an ornament hanging system for hanging ornaments on trees and structures at a height significantly above unassisted human reach.

Description of the Related Art

Numerous ornament-hanging systems have been described in a crowded field of prior art.

An exemplary disclosure of conventional ornament hanging systems can be appreciated from a review of U.S. Pat. No. 5,553,905, issued Sep. 10, 1996 to Bentivegna, hereinafter "Bentivegna"; the entire contents of which are hereby incorporated by reference.

While Bentivegna provides a useful system for hanging ornaments, particularly on trees and structures at a height significantly above unassisted human reach, there remain certain problems and disadvantages requiring improvement.

For example, the conventional ornament hook, as shown in FIGS. 16(a-c) of Bentivegna, is difficult to orient during hanging when using a conventional hanging apparatus such as that disclosed in Bentivegna. More specifically, with the conventional ornament hook positioned on the Bentivegna hanging apparatus, the conventional ornament hook is difficult to position such that the hook might engage a tree branch or other structure for ornament hanging. In fact, the Bentivegna hanging apparatus, and similar poles, actually obstruct the hanging hook and render the process of ornament hanging unduly complicated and inefficient.

These, and other problems as appreciated by one having skill in the art, are solved by the improved ornament hanging system as disclosed herein.

SUMMARY

An improved ornament-hanging system includes an ornament-hanging apparatus and one or more ornament-hanging hooks, wherein each of the one or more ornament-hanging hooks comprises an ornament-engaging loop, a first engagement-element for engaging a tree branch or other hanging structure, and a second engagement element disposed between the ornament-engaging loop and the first engagement-element for contact with the ornament-hanging apparatus during hanging. The second engagement-element comprises second bend having a plurality of flections, wherein a portion of the second bend forms a fulcrum, wherein upon engagement with the ornament-hanging apparatus at the fulcrum the ornament attached at the ornament-engaging loop is balanced gravitationally such that the first-engagement element is positioned upright and in an unobstructed manner. Thus, with the ornament-hanging hook as disclosed herein, a user may lift the ornament and engaged ornament-hanging hook upwardly, using the ornament-hanging apparatus, without obstruction to the first engagement for attaching the first engagement-element to a tree branch or other hanging structure.

In one aspect, the invention is provided as an ornament-hanging hook with novel features and benefits as disclosed herein.

In another aspect, the invention is provided as an ornament hanging system that includes an ornament-hanging apparatus and one or a plurality of the ornament-hanging hooks, the system configured for hanging decorative ornaments, particularly on trees and structures at a height significantly above unassisted human reach.

DETAILED DESCRIPTION

Figure 1:
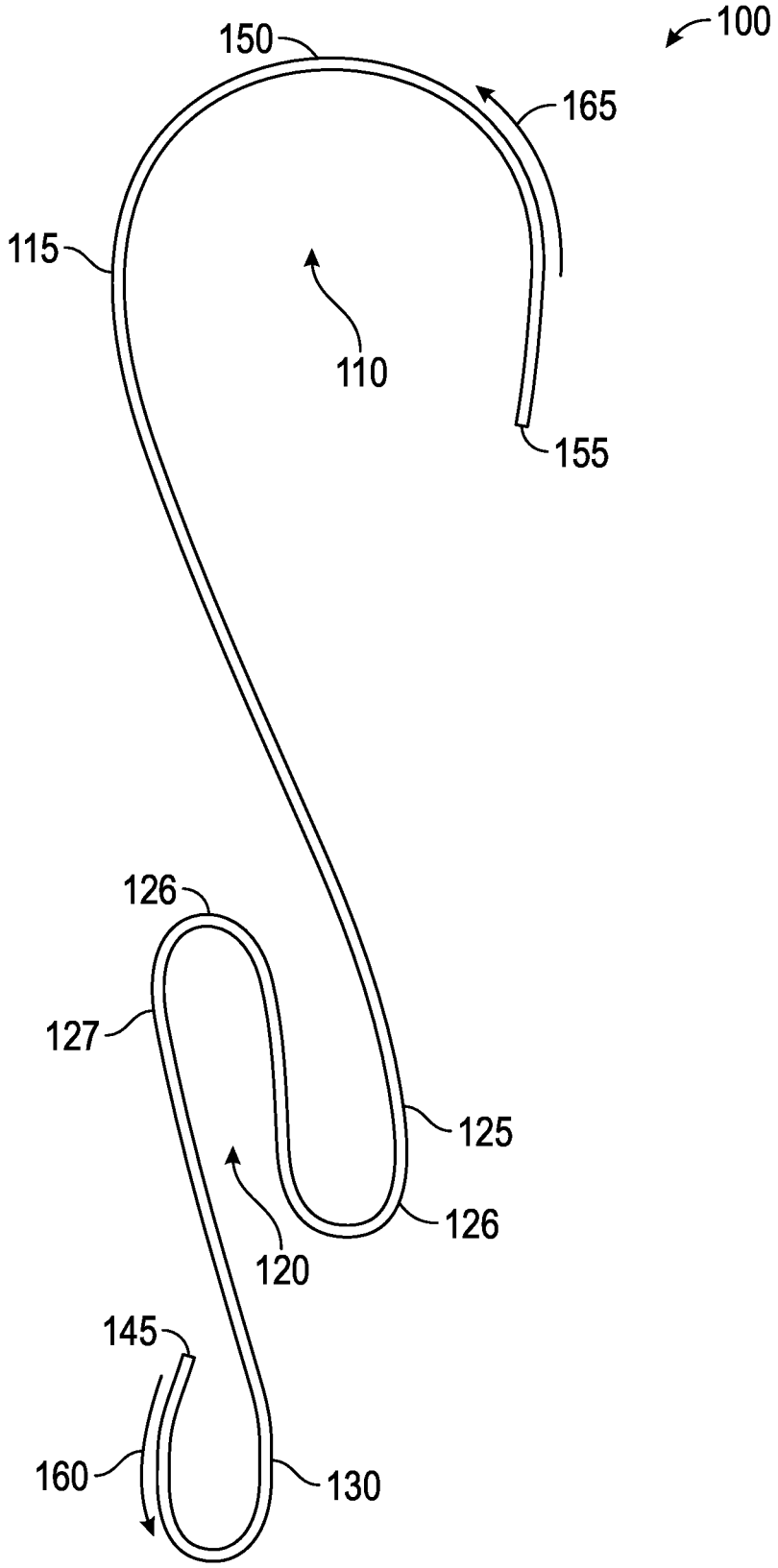
FIG. 1 shows a front view of an ornament-hanging hook in accordance to a first illustrated embodiment.

In the following description, for purposes of explanation and not limitation, details and descriptions are set forth in order to provide a thorough understanding of the embodiments of the invention. However, it will be apparent to those skilled in the art that the present invention may be practiced in other embodiments, including certain variations or alternative combinations that depart from these details and descriptions. The examples disclosed herein are intended to enable those with skill in the art to practice the invention, but such examples shall not reasonably be construed as limiting the spirit and scope of the invention as claimed.

For purposes herein, the term "'n' degree bend" means a degree of bend characterized by "n degrees", or to the angle to which the bend is formed, and would be appreciated by one with skill in the art. For example, a ninety-degree bend is one that creates a right-angle, a one-hundred-eighty degree bend creates a u-shape, etc.

"Curvature path" means a rotation direction of a portion of the ornament-hanging hook, beginning at a terminal end of said ornament-hanging hook. A curvature path can be characterized as having a rotation direction that is either clockwise or counter-clockwise.

"Flection" means a condition of being bent.

"Sigmoid curve" means having a characteristic "S"-shaped curve. The sigmoid curve can either be symmetrical or asymmetrical.

Unless explicitly defined herein, terms are to be construed in accordance with the plain and ordinary meaning as would be appreciated by one having skill in the art.

GENERAL DESCRIPTION OF EMBODIMENTS

In a first embodiment, an ornament-hanging hook is disclosed, the ornamental-hanging hook comprises a monolithic filament extending from a proximal end to a distal end. The monolithic filament comprises an ornament-engaging loop disposed at the proximal end, a first-engagement element disposed at the distal end and a second-engagement element disposed between the ornament-hanging loop and the first-engagement element along a length of the monolithic filament. The ornament-engaging loop is configured to engage at least a portion of a decorative ornament. The first-engagement element is configured to engage at least a portion of a tree branch or other hanging structure. The first-engagement element comprises a first bend of the monolithic filament, wherein the first bend is characterized as one that is at least ninety degrees. The second-engagement element comprises a second bend of the monolithic filament, wherein the second bend comprises a sigmoid curve, and wherein a portion of the sigmoid curve is configured to engage at least a portion of an ornament-hanging apparatus for hanging the decorative ornament on the tree branch or other hanging structure.

In some embodiments, the first bend may be characterized as one that is at most two-hundred seventy degrees. The first bend may comprise a plurality of smaller bends wherein the plurality of smaller bends is characterized as one that is at least ninety degrees.

In a preferable embodiment, the ornament-engaging loop and the first-engagement element may each comprise a curvature path having a same rotation direction. In alternative embodiments, the ornament-engaging loop and the first-engagement element may each comprise a curvature path having an opposite rotation direction.

In a second-embodiment, an ornament-hanging hook comprises an ornament-engaging loop disposed at a proximal end, the ornament-engaging loop being configured to engage at least a portion of a decorative ornament. The ornament-hanging hook further comprises a first-engagement element and a second-engagement element. The first-engagement element is disposed at a distal end opposite the proximal end and configured to engage at least a portion of a tree branch or other hanging structure. The first-engagement element includes first bend. The second-engagement element is disposed between the ornament-engaging loop and the first-engagement element. The second-engagement element comprises a second bend, wherein the second bend comprises a plurality of flections, and wherein a portion of the second bend is configured to engage at least a portion of an ornament-hanging apparatus for hanging the decorative ornament on the tree branch or other hanging structure.

Generally, the ornament-hanging hook may comprise a monolithic filament extending from the proximal end to the distal end.

In some embodiments, the first bend may be characterized as one that is at least ninety degrees.

In some embodiments, each of the plurality of flections may be characterized as one that is at least one hundred eighty degrees, wherein one hundred and eighty degrees is characterized as being a "U"-shape.

In some embodiments, the first bend may comprise a plurality of smaller bends wherein the plurality of smaller bends is characterized as one that is at least ninety degrees.

Generally, the second bend may further comprise a sigmoid curve, wherein a portion of the sigmoid curve is configured to engage at least a portion of the ornament-hanging apparatus.

In some embodiments, the ornament-engaging loop and the first-engagement element may each comprise a curvature path having a same rotation direction. In other embodiments the ornament-engaging loop and the first-engagement element may each comprise a curvature path having an opposite rotation direction.

In a third embodiment, an ornament-hanging system, comprises an ornament-hanging hook and an ornament-hanging apparatus. The ornament-hanging hook comprises: an ornament-engaging loop disposed at a proximal end, a first-engagement element disposed at a distal end opposite the proximal end, and a second-engagement element disposed between the ornament-engaging loop and the first-engagement element The ornament-engaging loop is configured to engage at least a portion of a decorative ornament. The first-engagement element includes a first bend, and the second-engagement element comprises a second bend having a plurality of flections. The ornament-hanging apparatus comprises an engagement feature coupled to an elongated pole. The engagement feature is configured to engage at least a portion of the second bend for hanging the decorative ornament on a tree or other hanging structure via the first-engagement element.

In the third embodiment, the engagement feature may further comprise a magnet element and the ornament-hanging hook may comprise a corresponding ferrous element configured to provide a magnetic coupling therebetween.

In some embodiments, the ornament-hanging apparatus may further comprise a plurality of concentrically-nested portions such that the ornament-hanging apparatus is configured to expend and collapse.

In some embodiments, the system may further comprise a plurality of ornament-hanging hooks wherein each of the plurality of ornament-hanging hooks comprises one of a plurality of sizes.

In some embodiments, the second bend may further comprise a sigmoid curve, wherein a portion of the sigmoid curve is configured to engage at least a portion of the ornament-hanging apparatus.

In a preferable embodiment, the ornament-hanging hook may comprise a monolithic filament extending from the proximal end to the distal end.

A function of the ornament-hanging hook and system is to eliminate any need for using a ladder, thereby improving safety, reducing time required for hanging ornaments, and overall improving ornament-hanging efficiency.

Manufacturing

The ornament-hanging hook may comprise a thermoplastic material, or more preferably a metal, such as steel, aluminum and the like. In some embodiments, the ornament-hanging hook may comprise a shape-memory metal, such as nitinol. Generally, the ornament-hanging hook comprises a monolithic filament. Preferable embodiments comprise a thickness of 12 gauge. Alternative thicknesses can also be used to achieve similar function.

A wire bending machine may be used to bend the shape of the monolithic filament for manufacturing the ornament-hanging hook. Alternatively, the ornament-hanging hook may be cast or molded using conventional techniques known to one having skill in the art.

Generally, the ornament-hanging apparatus comprises thermoplastic, metal, or a combination thereof. The ornament-hanging apparatus may comprise a plurality of concentrically-nested portions such that the apparatus is configured to expand during use and collapse for storage.

Figure 6:
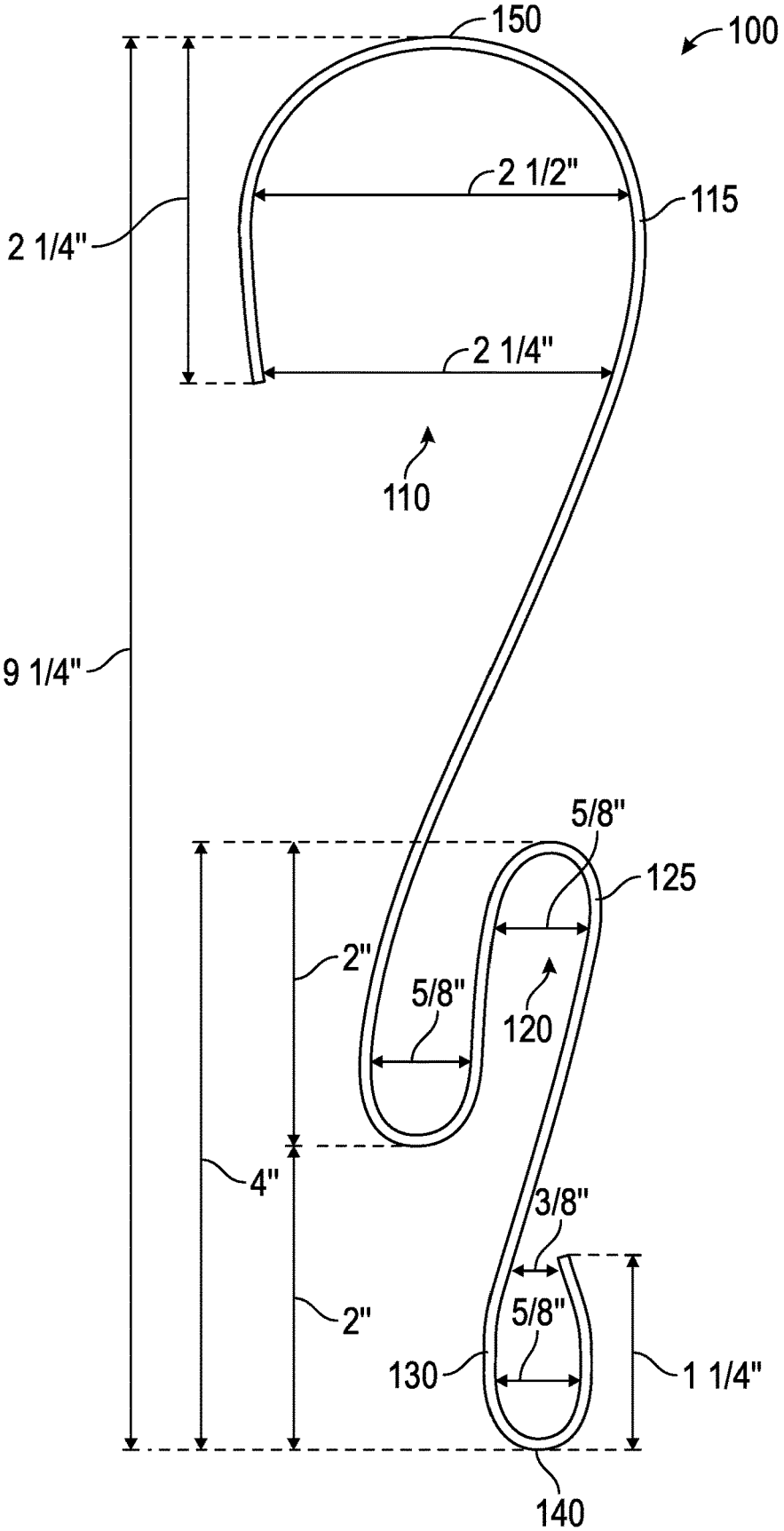
FIG. 6 shows a side view of a schematic of an ornament-hanging hook in accordance to a third illustrated embodiment.

Each of the components of the ornament-hanging hook and related system described herein may be manufactured and/or assembled in accordance with the conventional knowledge and level of a person having skill in the art. An exemplary embodiment with dimensions of an ornament-hanging hook is illustrated in FIG. 6. Dimensions provided for illustrative purposes and one having skill in the art will appreciate that other dimensions may be utilized.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Figure 4:
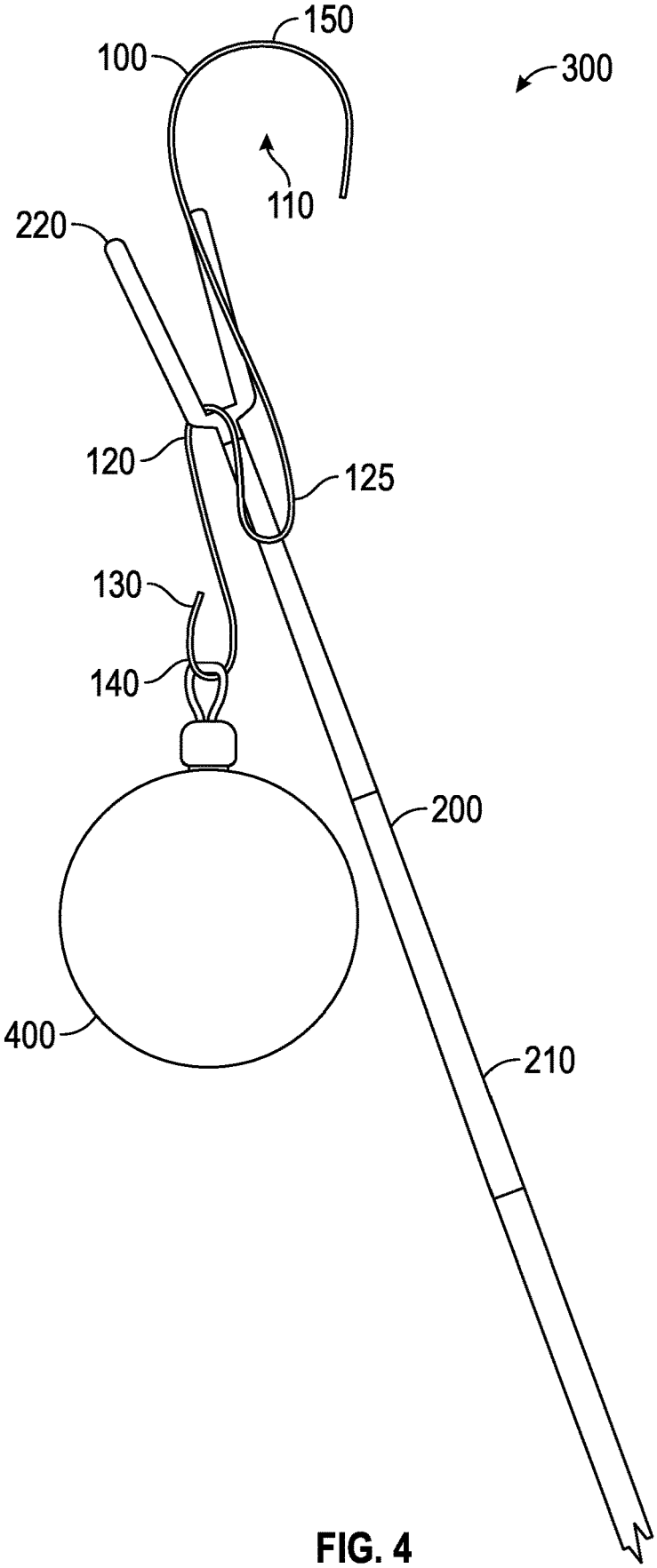
FIG. 4 shows a side view of an ornament-hanging system in accordance to a second illustrated embodiment.

FIG. 1 shows a front view of an ornament-hanging hook (100) in accordance to a first illustrated embodiment. The ornament-hanging hook comprises a monolithic filament extending from a proximal end (140) to a distal end (150) wherein an ornament-engaging loop (130) is disposed at the proximal and a first-engagement element (110) is disposed at the distal end. The ornament-engaging loop is configured to engage at least a portion of a decorative ornament and the first-engagement element is configured to engage at least a portion of a tree branch or other hanging structure. Disposed between the ornament-engaging loop and the first-engagement element along a length of the ornament-hanging hook is a second-engagement element (120), wherein the second-engagement element is configured to engage with an ornament-hanging apparatus (FIG. 4, 200). The first-engagement element further comprises a first bend (115) and the second-engagement element further comprises a second bend (125).

The first bend (115) is characterized as one that is at least ninety degrees and up to two-hundred seventy degrees and may contain superfluous bends which only adds an ornamental quality and which provides no additional function or utility. The second bend (125) comprises a plurality of flections (126) thereby forming a fulcrum for the ornament-hanging apparatus (FIG. 4, 200) to engage therewith. While the ornament-hanging apparatus is engaged with the second bend at the fulcrum, the ornament-engaging loop (130) is balanced gravitationally such that the first-engagement element (110) is positioned upright and in an unobstructed view from a user's perspective. The ornament-hanging hook may accommodate decorative ornaments of various sizes and weights and still provide an equilibrium state such that the first-engagement element remains upright, ready for attachment to a tree branch or other hanging structure. The plurality of flections illustrates a quantity of two flections for the second bend. Other embodiments have a second blend which comprises a number of flections greater than two while achieving comparable function and utility.

As illustrated, the plurality of flections (126) of the second bend (125) forms a sigmoid curve (127), which can be characterized an "S" shape. One having ordinary skill in the art will appreciate other shapes and formations for the second bend. Other examples may include, without limitation, a "Z" shape or any other shape comprising a variety of angles including angles characterized as being sharp, smooth, acute, and/or obtuse.

The ornament-hanging hook (100) additionally comprises a first curvature path (160) located at the proximal end (140), said proximal end having a first terminal end (145). The first curvature path can be characterized as having a direction of rotation being counter-clockwise when beginning from the first terminal and following along the monolithic filament. Furthermore, a second curvature path (165) is shown located at the distal end (150) and wherein the direction of rotation is also counter-clockwise when beginning from a second terminal end (155). As such, the first illustrated embodiment shows the first and second curvature paths having same direction of rotation, namely counter-clockwise. In other embodiments, the first and second curvature paths may comprise a rotation direction which are both clockwise, or alternatively having opposite rotation directions, namely one clockwise and another counter-clockwise.

Figure 2:
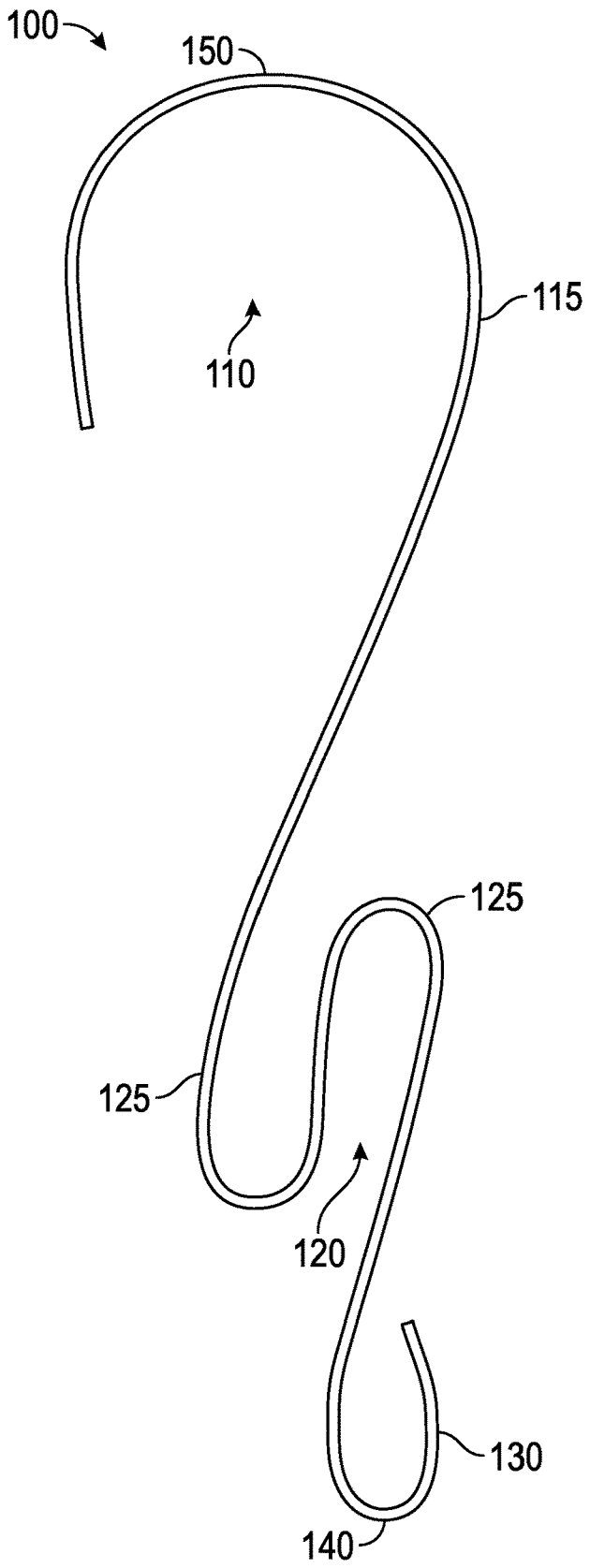
FIG. 2 shows a rear view of the ornament-hanging hook in accordance to the first illustrated embodiment.

FIG. 2 shows a rear view of the ornament-hanging hook (100) in accordance to the first illustrated embodiment. The ornament-hanging hook comprises a monolithic filament having a first-engagement element (110) disposed at a distal end (150), an ornament-engaging loop (130) disposed at a proximal end (140), and a second-engagement element (120) disposed therebetween on said monolithic filament. The first-engagement element further comprises a first bend and the second-engagement element further comprises a second bend (125) having a plurality of flections (125) wherein an ornament-hanging apparatus (FIG. 4, 200) is configured to engage to a portion therewith. The ornament-hanging hook can be configured for storage after initial use and reused for subsequent decorating.

Figure 3:
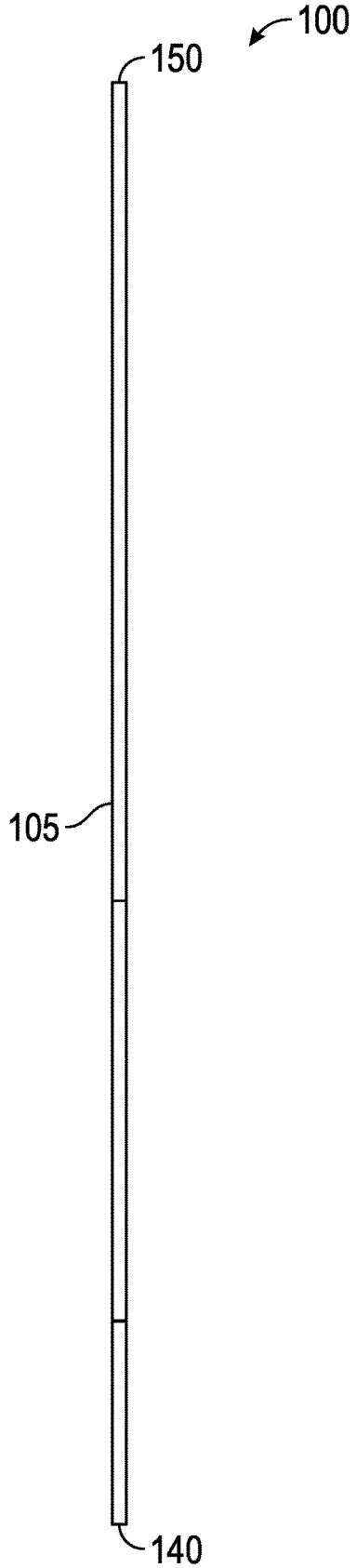
FIG. 3 shows a left-side view of the ornament-hanging hook in accordance to the first illustrated embodiment.

FIG. 3 shows a left-side view of the ornament-hanging hook (100) in accordance to the first illustrated embodiment. The ornament-hanging hook comprises a proximal end (140) and a distal end (150) opposite the proximal end. The ornament-hanging hook further comprises a thickness (105). Determination of the thickness depends on various factors including hook material, size of the ornament-hanging hook, and weights of decorative ornaments,

Second Illustrated Embodiment

FIG. 4 shows a side view of an ornament-hanging system (300) in accordance to a second illustrated embodiment. The ornament-hanging system includes at least one ornament-hanging hook (100) and an ornament-hanging apparatus (200). The system is provided for hanging ornaments on trees and similar structures. The ornament-hanging hook comprises a first-engagement element (110), a second-engagement element (120), and an ornament-engaging loop (130). As illustrated, the first-engagement element remains unobstructed when held by the ornament-hanging apparatus. Here, the ornament-hanging apparatus includes an elongated pole (210) with an engagement feature (220) disposed at one end of the ornament-hanging apparatus. The engagement feature may comprise a variety of shapes including a fork as shown. The engagement feature of the ornament-hanging apparatus is configured to engage the second-engagement element, which is disposed between the first-engagement element at a distal end (150) and the ornament-engaging loop at a proximal end (140). In this regard, the ornament-hanging apparatus does not engage the first-engagement element, and because the first-engagement element is separated by a distance from the second-engagement element, the first-engagement element remains unobstructed when the engagement feature of the ornament-hanging apparatus engages the second-engagement element and hanging a decorative ornament (400) is effectuated. The decorative ornament as shown is a traditional spherical shape, but one having skill in the art will appreciate other shaped decorative ornaments may also be utilized with the ornament-hanging system.

The ornament-hanging system (300) may comprise a plurality of ornament-hanging hooks (100) wherein each of the plurality of ornament-hanging hooks comprises one of a plurality of hook sizes, such as small, medium, and large.

In some embodiments, at least one of the ornament-hanging hooks (100) and engagement feature (220) may comprise a magnetic element, and the other of the ornament-hanging hook and engagement feature of the ornament-hanging apparatus (200) may comprise a corresponding ferrous element or magnet for providing a magnetic engagement therebetween. In this regard, the ornament-hanging hook may be magnetically coupled to the engagement feature and easily removed with minimal user-provided force, such as a twisting motion, during hanging.

Use of the ornament-hanging system (300) is used, by any order, engaging a portion of the decorative ornament (400) with the ornament-engaging loop (130); engaging the second-engagement element (120) with the engagement feature (220) of the ornament-hanging apparatus (200); using the elongated pole (210) of the ornament-hanging apparatus, lifting the ornament-hanging hook (100) and hanging said ornament-hanging hook to a tree branch or other hanging structure.

Figure 5:
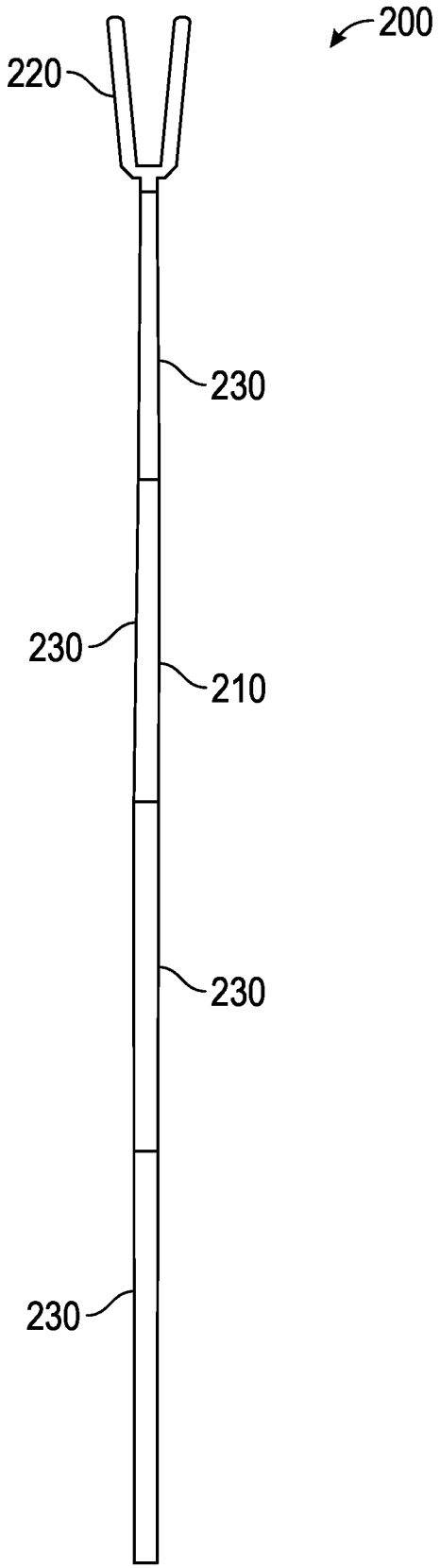
FIG. 5 shows a front view of an ornament-hanging apparatus in accordance to the second illustrated embodiment.

FIG. 5 shows a front view of an ornament-hanging apparatus (200) in accordance to the second illustrated embodiment. The ornament-hanging apparatus comprises an elongated pole (210) and an engagement feature (220) coupled to an end of the elongated pole. The elongated pole comprises a plurality of concentrically-nested portions such that the ornament-hanging apparatus is configured to expand during hanging and collapse during storage. In other embodiments, the ornament-hanging apparatus is static in length.

Third Illustrated Embodiment

FIG. 6 shows a side view of a schematic of an ornament-hanging hook (100) in accordance to a third illustrated embodiment. Dimensions provided are one example and one having skill in the art will appreciate that different dimensions may also be used. A first-engagement element (110) having a first bend (115) is disposed at a distal end (150) of the ornament-hanging hook having a monolithic filament. An ornament-engaging loop (130) is disposed at a proximal end (140) opposite the distal end. A second-engagement element (120) having a second bend (125) is disposed on monolithic filament at a portion between the proximal end and distal end such that when an ornament-hanging apparatus is engaged with a portion of the second bend, the ornament-hanging hook is gravitationally balanced with the first-engagement element upright.

While various details, features, and combinations are described in the illustrated embodiments, one having skill in the art will appreciate a myriad of possible alternative combinations and arrangements of the features and details disclosed herein. As such, the descriptions are intended to be enabling only, and non-limiting. Instead, the spirit and scope of the invention is intended to be determined from the appended claims.

FEATURE LIST ornament-hanging hook (100)
thickness (105)
first-engagement element (110)
first bend (115)
second-engagement element (120)
second bend (125)
plurality of flections (126)
sigmoid curve (127)
ornament-engaging loop (130)
proximal end (140)
first terminal end (145)
distal end (150)
second terminal end (155)
first curvature path (160)
second curvature path (165)
ornament-hanging apparatus (200)
elongated pole (210)
engagement feature (220)
plurality of concentrically-nested portions (230)
ornament-hanging system (300)
decorative ornament (400)

What is claimed is:

1. An ornament-hanging system comprising an ornament-hanging hook and an ornament-hanging apparatus, the ornament-hanging hook comprising:

a monolithic filament extending from a proximal end to a distal end, the monolithic filament comprising an ornament-engaging loop, a first-engagement element, and a second-engagement element connected to each of the ornament-engaging loop and the first-engagement element, characterized in that:

the ornament-engaging loop extends from the proximal end to the second-engagement element, the ornament-engaging loop being characterized as a bottommost portion of the ornament-hanging hook;

the first-engagement element extends from the distal end to the second-engagement element, the first-engagement element having a curved shape such that it can hook around and at least partially engage with a portion of a tree branch or other hanging structure and being characterized as an uppermost portion of the ornament-hanging hook;

and the second-engagement element is disposed between the ornament-engaging loop and the first-engagement element along a length of the monolithic filament, the second-engagement element comprising a plurality of flections including a first flection connected to the ornament-engaging loop and a second flection connected to the first-engagement element, the first flection disposed between the ornament-engaging loop and the second flection along the length of the monolithic filament;

wherein each portion of the first flection is on a same plane as each portion of the second flection;

wherein the ornament-engaging loop and first-engagement element each comprise a curvature path having a same single rotation direction;

wherein while the first-engagement element is positioned upright such that each portion of the ornament-engaging loop is disposed vertically under the first-engagement element, each portion of the first flection is disposed above each portion of the second flection relative to the bottommost and uppermost portions; and wherein the ornament-hanging hook maintains a substantially vertical orientation when the first flection rests but can freely rotate on a support structure; and the ornament-hanging apparatus comprising:

an engagement feature coupled to an elongated pole, wherein the engagement feature is configured to engage with a portion of the second flection;

and wherein the ornament-hanging hook has a weight distribution such that upon the ornament-hanging apparatus engaging with the second flection and an ornament engaged with the ornament-engaging loop, the ornament-hanging hook is balanced such that the first-engagement element is positioned upright relative to the ornament-engaging loop.

2. The ornament-hanging system of claim 1, wherein the first-engagement element has a radius of curvature of at most two-hundred seventy degrees.

3. The ornament-hanging system of claim 1, wherein the engagement feature further comprises a magnet element and the ornament-hanging hook further comprises a corresponding ferrous element configured to provide a magnetic coupling therebetween.

4. The ornament-hanging system of claim 1, the ornament-hanging apparatus further comprising a plurality of concentrically-nested portions such that the ornament-hanging apparatus is configured to expand and collapse.

5. An ornament-hanging system comprising an ornament-hanging hook and an ornament-hanging apparatus, the ornament-hanging hook comprising:

an ornament-engaging loop disposed at a proximal end, the ornament-engaging loop being characterized as a bottommost portion of the ornament-hanging hook;

a first-engagement element disposed at a distal end opposite the proximal end, the first-engagement element having a curved shape such that it can hook around and at least partially engage with a portion of a tree branch or other hanging structure and being characterized as an uppermost portion of the ornament-hanging hook; and a second-engagement element disposed between the ornament-engaging loop and the first-engagement element, the second-engagement element comprising a plurality of flections including a first flection connected to the ornament-engaging loop and a second flection connected to the first-engagement element, the first flection disposed between the ornament-engaging loop and the second flection along a length of the ornament-hanging hook;

wherein each portion of the first flection is on a same plane as each portion of the second flection;

wherein the ornament-engaging loop and first-engagement element each comprise a curvature path having a same single rotation direction;

wherein while the first-engagement element is positioned upright such that each portion of the ornament-engaging loop is disposed vertically under the first-engagement element, each portion of the first flection is disposed above each portion of the second flection relative to the bottommost and uppermost portions; and wherein the ornament-hanging hook maintains a substantially vertical orientation when the first flection rests but can freely rotate on a support structure; and the ornament-hanging apparatus comprising:

an engagement feature coupled to an elongated pole, wherein the engagement feature is configured to engage with a portion of the second flection, and wherein the ornament-hanging hook has a weight distribution such that upon the ornament-hanging apparatus engaging with the second flection and an ornament engaged with the ornament-engaging loop, the ornament-hanging hook is balanced such that the first engagement element is positioned upright relative to the ornament-engaging loop.

6. The ornament-hanging system of claim 5, wherein the ornament-hanging hook comprises a monolithic filament extending from the proximal end to the distal end.

7. The ornament-hanging system of claim 5, wherein the first-engagement element has a radius of curvature of at least ninety degrees.

8. The ornament-hanging system of claim 5, wherein each of the plurality of flections has a radius of curvature of at least one hundred eighty degrees.

9. The ornament-hanging system of claim 5, the second flection further comprising a sigmoid curve, wherein a portion of the sigmoid curve is configured to engage at least a portion of the ornament-hanging apparatus.

10. The ornament-hanging system of claim 5, wherein the engagement feature further comprises a magnet element and the ornament-hanging hook further comprises a corresponding ferrous element configured to provide a magnetic coupling therebetween.

11. The ornament-hanging system of claim 5, the ornament-hanging apparatus further comprising a plurality of concentrically-nested portions such that the ornament-hanging apparatus is configured to expand and collapse.

* * * * *